US006505999B1

(12) United States Patent
Lothspeich

(10) Patent No.: US 6,505,999 B1
(45) Date of Patent: Jan. 14, 2003

(54) RETAINING WALL STRUCTURE FOR SOIL STABILIZATION INCLUDING DOUBLE LAYER OF GEOGRID WEB MATERIAL TO PROVIDE HIGH STRENGTH CONNECTION WITH BACKFILL MATERIAL

(75) Inventor: Steven Edward Lothspeich, Charlotte, NC (US)

(73) Assignee: Huesker, Inc., Charlotte, NC (US)

( * ) Notice: Subject to any disclaimer, the term of this patent is extended or adjusted under 35 U.S.C. 154(b) by 0 days.

(21) Appl. No.: 09/864,908

(22) Filed: May 24, 2001

(51) Int. Cl.[7] ..... E02D 29/02
(52) U.S. Cl. ..... 405/284; 405/262; 405/286
(58) Field of Search ..... 405/262, 284, 405/286

(56) References Cited

U.S. PATENT DOCUMENTS

| | | | | |
|---|---|---|---|---|
| 4,616,959 | A | * 10/1986 | Hilfiker | 405/286 |
| 4,914,876 | A | 4/1990 | Forsberg | |
| 5,066,169 | A | 11/1991 | Gavin et al. | |
| 5,177,925 | A | * 1/1993 | Winkler et al. | 405/284 X |
| 5,851,089 | A | 12/1998 | Beretta | |
| 5,975,809 | A | 11/1999 | Taylor et al. | |
| 6,024,516 | A | 2/2000 | Taylor et al. | |
| 6,079,908 | A | 6/2000 | Anderson | |
| 6,168,351 | B1 | 1/2001 | Rainey | |
| 6,193,445 | B1 | 2/2001 | Scales | |
| 6,224,295 | B1 | * 5/2001 | Price et al. | 405/262 |
| 6,447,211 | B1 | * 9/2002 | Scales et al. | 405/262 |

OTHER PUBLICATIONS

ICBO Evaluation Service, Inc., "Verdura and Candura Segmental Retaining Wall Systems," ICBO Evaluation Service, Inc. (Whittier), p. 1–2, (Mar. 1, 2000).

"Fortrac Geogrids", Huesker Inc. (Charlotte, NC), p. 1–8.

"Keystone Modular Block Wall and Fortrac—Geogrids," Huesker Synthetic GmbH & Co. (Germany), p. 1–2, (May, 1999).

"Rockwood Block Segmental Retaining Wall with Fortrac, Geogrids," Huesker Synthetic GmbH & Co. KG (Germany), p. 1–2, (Aug., 2000).

"Allan Block Segmental Retaining Wall with Fortrac, Geogrids," Huesker Synthetic GmbH & Co., (Germany), p. 1–2, (Aug., 2000).

* cited by examiner

*Primary Examiner*—David Bagnell
*Assistant Examiner*—Sunil Singh
(74) *Attorney, Agent, or Firm*—Jenkins & Wilson, P.A.

(57) ABSTRACT

A retaining wall connection for mechanically stabilized earth structures comprising a plurality of courses of cementations blocks stacked together to define a retaining wall and having a backfill material provided behind the retaining wall. A first layer of geogrid web material has a leading edge disposed between vertically adjacent blocks at a predetermined vertical height of the retaining wall with the trailing edge of the first layer of geogrid web material extending backwardly into the backfill material so as to be engaged thereby. A second layer of geogrid web material is provided so as to overlay and contact the first layer of geogrid web material from the leading edge thereof to at least a medial portion of the first layer of geogrid web material in order to provide a significant increase in the connection strength in the retaining wall and the backfill material. A method for forming a retaining wall structure for mechanically stabilized earth is also described.

27 Claims, 3 Drawing Sheets

Summary of connection capacities for Huesker FORTRAC 35MP geogrid combination

RETAINING WALL STRUCTURE FOR SOIL STABILIZATION INCLUDING DOUBLE LAYER OF GEOGRID WEB MATERIAL TO PROVIDE HIGH STRENGTH CONNECTION WITH BACKFILL MATERIAL

TECHNICAL FIELD

The present invention relates to retaining wall structures for reinforcement of earthen walls and slopes. More particularly, the present invention relates to a retaining wall reinforcement for earthen walls and slopes that includes the use of a secondary layer of geogrid web material overlaying a primary layer of geogrid web material and both being disposed at a predetermined vertical height of the retaining wall face and extending laterally backwardly therefrom into the backfill material.

RELATED ART

Retaining walls, steep slopes and embankments of earth often require reinforcement to prevent unacceptable soil movement. Generally, soil reinforcement is required in construction involving roadways, foundations, retaining walls, and the like, in which soils are susceptible to movement. While reinforcement can be accomplished by using high quality, select soil, it is often desired to reuse existing soil at construction sites. In such circumstances, and sometimes even with the use of supplemental select soils, acceptable safety factors require the construction of additional structures to effect stabilization of the soil in the earthen structure.

While some soil stabilization applications use underlayments or layers of sheet materials which are covered with backfill materials, other applications incorporate retaining walls from which single layer sheet materials extend and are covered with backfill materials. The retaining walls are typically constructed of a plurality of blocks which connect together. Some conventional and well-known blocks have bores which receive pins or dowels therein to connect the blocks in vertically adjacent tiers. Other types of blocks have opposing top and bottom surfaces which are often configured for interlocking engagement in order for the wall made of the blocks to be mechanically connected together.

The previously described retaining walls also generally include at least one laterally extending horizontal reinforcing sheet that prevents sliding or rotational failure of the slope. In a typical site construction, the retaining wall includes many vertically spaced-apart sheets extending from the retaining wall into the backfill material. A side portion of the sheet attaches to the wall, such as by being held between adjacent tiers of blocks or by connectors disposed in the wall, and the other side portion extends outwardly and rearwardly from the wall into the backfill material. The backfill material mechanically secures the sheet to the backfill, and thereby secures the retaining wall to the backfill.

Several different types of sheets are well-known to those skilled in the art for use to mechanically stabilize earth as described hereinabove. The sheets are generally woven, knitted, or stitch-bonded textiles or extruded, oriented plastic sheets. The extruded plastic sheets typically are extruded geogrids made from oriented polymer plastics and having relatively large openings or apertures therein defined by longitudinal ribs and transverse bars. While extruded geogrid webs are used to secure retaining walls to backfill materials, the conventional use of a single layer of the extruded geogrid web at a predetermined vertical location in the retaining wall does have certain limitations in use in certain applications. It is believed that some of the limitations may derive from the use of backfill material which is substantially smaller than the apertures such that the geogrid does not satisfactorily mechanically engage the backfill material.

Accordingly, although there is widespread use of geogrid webs to provide a high-strength connection between a retaining wall and the backfill material behind the retaining wall, there is a long-felt need in the art for a geogrid web construction or application that provides a higher strength connection between a retaining wall and the backfill material behind the retaining wall. It is to address this long-felt need that the present invention was discovered and is now directed.

SUMMARY OF THE INVENTION

The present invention meets the need in the art for a higher strength connection between a modular block retaining wall and backfill material provided there behind. Briefly described, the present invention provides a retaining wall reinforcement for mechanically stabilized earth structures comprising a plurality of courses of cementations blocks stacked together so as to define a retaining wall, and including a backfill material provided behind the retaining wall. A first layer of geogrid web material having a leading edge and a trailing edge is provided wherein the leading edge is disposed between vertically adjacent blocks at a predetermined vertical height of the retaining wall and the trailing edge extends laterally backward therefrom and to the backfill material so as to be engaged thereby. A second layer of geogrid web material is provided so as to overlay and to contact the first layer of geogrid web material from the leading edge thereof to at least a medial portion thereof between the leading edge and the trailing edge. In this fashion, the use of a primary geogrid web layer having a secondary geogrid web layer positioned thereon and in contact therewith serves to provide an increase in the connection strength between the retaining wall and the backfill material as can be appreciated from the detailed description provided hereinafter.

It is therefore an object of the present invention to provide an improved retaining wall structure for mechanically stabilized earth wherein the connection strength between the modular block of the retaining wall and the soil mass of the backfill material adjacent the retaining wall is significantly increased.

Some of the objects of the invention having been stated hereinabove, other objects will become evident as the description proceeds when taken in connection with the accompanying drawings as described hereinbelow.

DETAILED DESCRIPTION OF THE INVENTION

Figure 1:
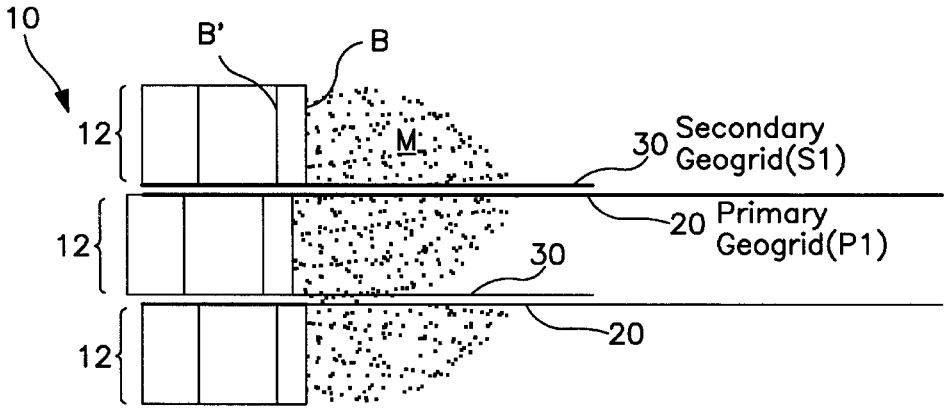
FIG. 1 is a schematic side elevation view of a first embodiment of the present invention used for reinforcement of mechanically stabilized earth structures.

Referring now in detail to FIGS. 1–4 of the drawings, in which like numerals indicate corresponding parts throughout the several views, the drawings illustrate a modular retaining wall that comprises a segmented wall of blocks B that are atop each other in ascending courses 12 as will be described in more detail hereinbelow. When stacked in courses as described, the blocks B together form an exterior surface of a wall which faces outwardly away from an earth embankment of fill material, and an interior wall or surface which faces inwardly toward the embankment of fill material. Typically, blocks B are stacked in a staggered arrangement (not shown) to provide the greatest stability to the retaining wall structure. Also, normally blocks B are substantially identical in size and shape for ease of block fabrication and retaining wall construction, and preferably each block B is configured so as to mate with at least one other block B when the blocks are stacked atop one another in courses B to form a retaining wall. Standard blocks B that can be used in the retaining wall structure of the invention and that are well-known in the art include ROCKWOOD™, KEYSTONE™, and ALLAN™ blocks. Of course, the use of other types of blocks B in order to form a retaining wall in accordance with the present invention is a matter of design choice and contemplated as being within the scope of the present invention.

Now, with reference again to FIGS. 1–4 of the drawings, the retaining wall structure of the present invention will be described in more detail. The retaining wall 10 of the retaining wall connection contemplated for use for mechanically stabilized soils comprises two (2) or more vertically-spaced tiers or courses 12 of blocks B placed side-by-side. Blocks B are preferably cast cementatious blocks with opposing exterior and interior surfaces. The exterior surface of blocks B may include ornamental designs which is conventional for cast blocks B. Blocks B further define channels B' through the blocks which open to the upper and lower surfaces of blocks B. Channels B' can be used to accept dowels or pins (not shown) so as to extend through the channels of the vertically spaced tiers to facilitate strength of retaining wall 10.

The retaining wall 10 of the present invention is constructed as described hereinafter and with reference to FIGS. 1–4. A site for wall 10 is selected, and a first tier or course 12 of foundation blocks B is placed side-by-side. A plurality of blocks B are then placed side-by-side in tiers or courses to form segmented block wall 10. Blocks B are preferably offset in order that the sides of the blocks in one tier are staggered with respect to the sides of the blocks in adjacent tiers. Backfill material M is placed behind retaining wall 10 and against the interior face of wall 10. Backfill material M can be soil or gravel designed to specifically meet the drainage and connection/anchorage requirements of the wall. At a selected height of wall 10, a primary layer of geogrid web 20 is pulled over the backfill M and over the upper surface of blocks B in a particular tier or course 12 of wall 10. The leading edge of primary geogrid web 20 is laid on the upper surface of blocks B and terminates at the exterior surface of blocks B in a selected tier or course. The trailing edge of primary geogrid web 20 extends outwardly over backfill material M. Next, a secondary geogrid web 30 is placed onto and in contact with primary geogrid web 20 from the leading edge of primary geogrid web 20 to at least the medial portion of primary geogrid web 20. Primary geogrid web 20 and relatively shorter secondary geogrid web 30 are in contact each with the other along the entire interface of the two (2) layers as can be fully appreciated with reference to FIGS. 1–4 of the drawings. Suitable geogrid webs for use in both the primary and secondary layers include FORTRAC® Style Nos. 20/13-20; 35/20-20; 55/30-20; 80/30-20; 110/30-20; 20/13-20/30MP; 35/20-20/30MP; 55/25-20/30MP; and 80/25-20/30MP available from Huesker, Inc. of Charlotte, N.C.

The addition of the relatively short secondary geogrid web 30 over the top of primary geogrid web 20 results in an increase of the connection strength between blocks B of retaining wall 10 and the soil mass or backfill material M behind retaining wall 10. Next, additional blocks B are placed on the previously selected tier or course 12 of blocks B to entrap the leading edge portion of primary geogrid web 20 and secondary geogrid web 30 overlaid thereon between the mating upper and lower surfaces of blocks B between vertically adjacent tiers. Once the desired additional selected number of tiers or courses 12 of blocks B are added to complete retaining wall 10, backfill material M is placed over the overlaying layers of primary geogrid web 20 and secondary geogrid web 30 in order to complete the retaining wall structure for mechanically stabilized earth. Backfill material M is preferably compacted, and will strike through the open apertures of primary and secondary geogrid webs 20 and 30, respectively, so as to fully engage the primary and secondary geogrid webs.

While the present retaining wall 10 has been described and is shown in FIGS. 1–4 of the drawings as consisting of only a single layer of primary and secondary geogrid webs 20 and 30, respectively, it will be appreciated that the retaining wall structure of the invention for mechanically stabilized earth may as a matter of design choice include additional vertically spaced-apart layers of primary and secondary geogrid webs 20 and 30, respectively, at selected tiers or courses 12 along the vertical height of retaining wall 10. For clarity of description, FIGS. 1–4 of the drawings only depict a two (2) tier or course retaining wall 10 consisting of a single layer of primary and secondary geogrid webs 20 and 30, respectively, extending from retaining wall 10 into backfill material M in order to form a high-strength connection therebetween. Also, while applicant prefers to use a primary and secondary layer comprising geogrid webs 20 and 30, respectively, it is contemplated that other types of geotextile layers can be used in the retaining wall structure (e.g., geotextile fabrics) within the scope of the invention as set forth in the claims appended hereto.

Figure 2:
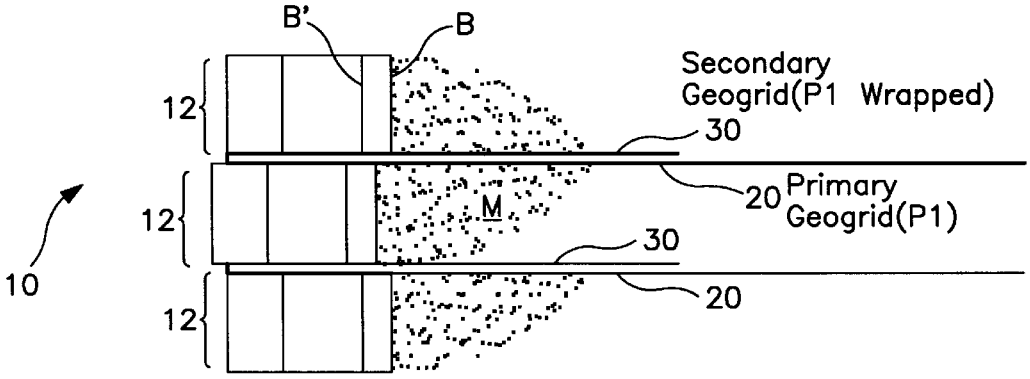
FIG. 2 is a schematic side elevation view of a second embodiment of the invention.
Figure 3:
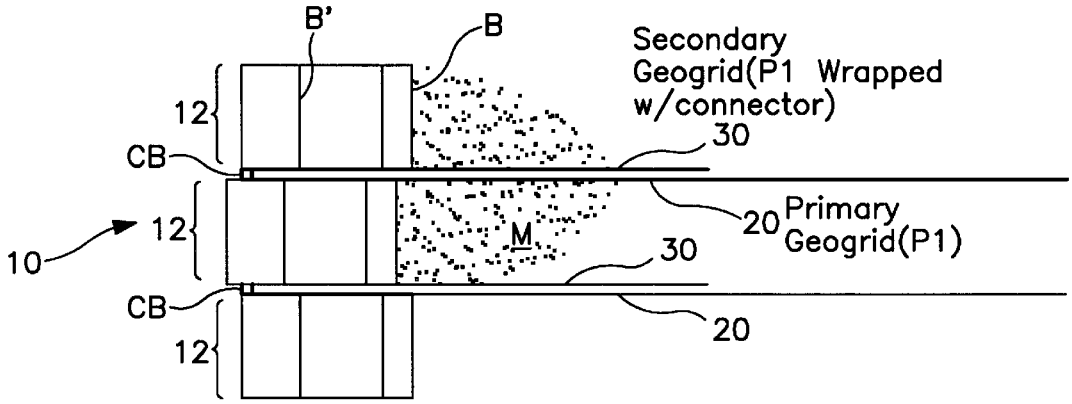
FIG. 3 is a schematic side elevation view of a third embodiment of the invention.
Figure 4:
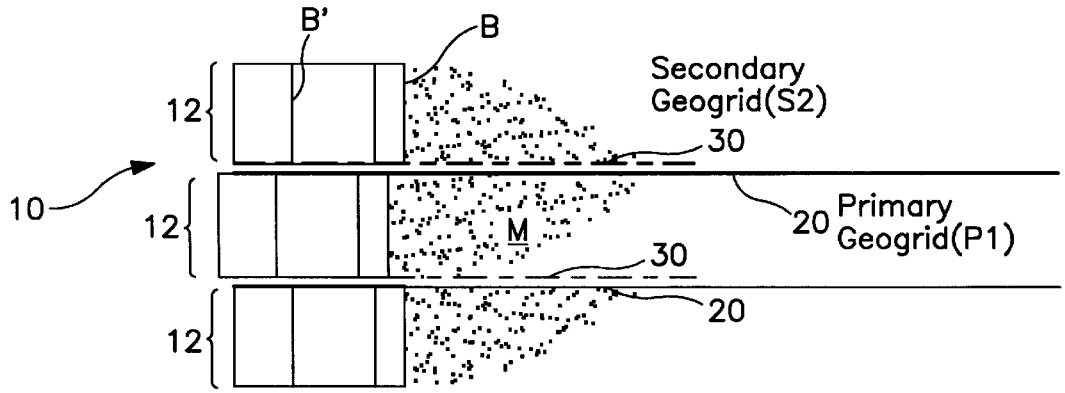
FIG. 4 is a schematic side elevation view of a fourth embodiment of the present invention.

Referring once again to FIGS. 1–4 of the drawings, four (4) representative embodiments of the present invention are shown and will be described herein. First of all, FIG. 1 depicts the use of a separate short secondary layer of geogrid web 30 on top of a relatively longer primary layer of geogrid web 20. FIG. 2 depicts a single folded layer of geogrid web wherein the lower run serves as the primary longer layer of geogrid web 20 and the top run is turned back upon the lower run to serve as the relatively shorter upper layer of geogrid web 30. FIG. 3 depicts a geogrid web similar to the material shown in FIG. 2 that is wrapped around a connector bar CB at the front face of retaining wall 10. Finally, FIG. 4 depicts a retaining wall structure in accordance with the present invention having an improved high-strength connection between the retaining wall and backfill material M wherein primary geogrid web 20 is overlaid with a different construction secondary geogrid web 30.

It will be appreciated that in all four (4) embodiments depicted in FIGS. 1–4 of the drawings, the relatively shorter top layer of geogrid web overlays and is in contact with the lower geogrid web along substantially the entirety of the coextensive length thereof. Although preferably the relatively short secondary geogrid web 30 extends backwardly from the leading edge primary geogrid web 30 towards the trailing edge thereof so as to run coextensively therewith and terminate at about 10%–30% of the total length of primary geogrid web 20, it is contemplated that secondary geogrid web 30 may also extend less than 10% or greater than 30% of the total length of primary geogrid web 20 as a matter of choice in constructing the retaining wall structure of the invention.

Testing Data

The use of secondary geogrid webs 30 to increase the connection strength between blocks B of retaining wall 10 and backfill material M therebehind has been discovered to increase the connection strength by nearly twice as can be understood with reference to Table 1 and Table 2 set forth below. Table 1 depicts data from the use of a single layer of Huesker FORTRAC® 35 MP geogrid with modular blocks. Table 2 depicts testing results when a primary and secondary layer of geogrid web formed of Huesker FORTRAC® 35 MP geogrid is used with the modular blocks. The results are as follows:

TABLE 1

Test Program: Single layer inclusion

| Test Number | Normal Load (lb/ft) | Approximate Wall Height (feet) | Approximate Number of Blocks | Service Ability Tensile Capacity (lb/ft) | Peak Tensile Capacity (lb/ft) |
|---|---|---|---|---|---|
| 1 | 413 | 3.4 | 5.2 | 673 | 750 |
| 2 | 743 | 6.2 | 9.3 | 877 | 908 |
| 3 | 1080 | 9.0 | 13.5 | 993 | 993 |
| 4 | 1087 | 9.0 | 13.6 | 1064 | 1064 |
| 5 | 1101 | 9.1 | 13.8 | 948 | 948 |
| 6 | 1445 | 12.0 | 18.1 | 1000 | 1000 |
| 7 | 1809 | 15.0 | 22.7 | 997 | 997 |
| 8 | 2387 | 19.8 | 29.9 | 1079 | 1079 |
| 9 | 2835 | 23.5 | 35.5 | 1018 | 1018 |

TABLE 2

Test Program: Double layer inclusion

| Test Number | Normal Load (lb/ft) | Approximate Wall Height (feet) | Approximate Number of Blocks | Service Ability Tensile Capacity (lb/ft) | Peak Tensile Capacity (lb/ft) |
|---|---|---|---|---|---|
| 1 | 1115 | 9.3 | 14.0 | 1643 | 1643 |
| 2 | 1108 | 9.2 | 13.9 | 1587 | 1587 |
| 3 | 1101 | 9.1 | 13.8 | 1569 | 1569 |
| 4 | 1803 | 15.0 | 22.6 | 1791 | 1791 |

Figure 5:
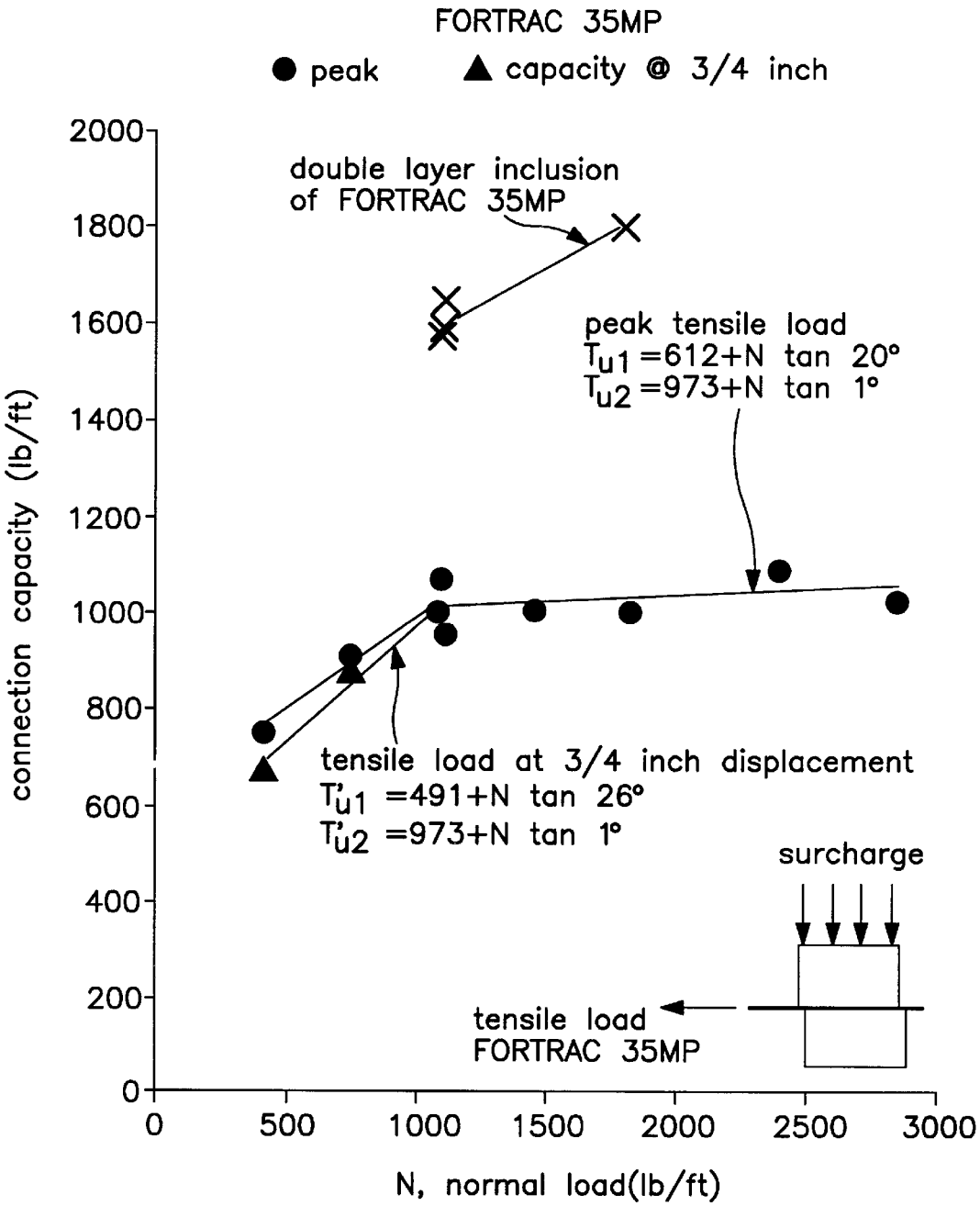
FIG. 5 is a graph of the prior art connection versus the double layer connection between the retaining wall structure and the backfill material therebehind.

As can be understood by reference to the data provided in Table 1 and Table 2 hereinabove comparing a conventional single layer retaining wall construction (Table 1) and the double layer geogrid web retaining wall construction (Table 2) of the invention, the connection strength between retaining wall 10 and backfill material M is increased by up to about a factor of 2 by use of the shorter secondary layer of geogrid web directly on top of and in contact with the primary layer of geogrid web 20 which has been used heretofore. The very significant increase in peak tensile capacity is unexpected, surprising and desirable in forming a retaining wall structure for soil stabilization of earthen slopes and embankments. The data set forth in Table 1 and Table 2 above is also set forth in a graph in FIG. 5 of the drawings for purposes of greater clarity.

It will be understood that various details of the invention may be changed without departing from the scope of the invention. Furthermore, the foregoing description is for the purpose of illustration only, and not for the purpose of limitation—the invention being defined by the claims.

What is claimed is:

1. A retaining wall structure for soil stabilization of earthen slopes and embankments, comprising:

(a) a plurality of courses of side-by-side and abutting cementatious blocks having a width and a depth and being stacked together to define a retaining wall;

(b) a backfill material provided behind the retaining wall;

(c) a lower layer of geotextile material having a width comprising a plurality of block widths defining a leading edge and a trailing edge, and having the leading edge disposed the entire depth between vertically adjacent blocks at a predetermined vertical height of the retaining wall, and the trailing edge extending laterally backward therefrom into the backfill material such that the layer is engaged by the backfill material; and (d) an upper layer of geotextile material having a width comprising a plurality of block widths so as to extend parallel and to overlay and contact at least a portion of the length of the lower layer of geotextile material; wherein the upper layer extends from the leading edge towards the trailing edge of the lower layer; and wherein the upper layer extends for a length from the retaining wall that is at least the depth disposed between the vertically adjacent blocks thereof;

whereby a high strength connection between the retaining wall and the backfill material by the lower and upper layers of geotextile material is provided.

2. The retaining wall structure according to claim 1 wherein the backfill material is soil or gravel designed specifically to meet drainage and connection/anchorage requirements of the wall.

3. The retaining wall structure according to claim 1 wherein the lower and upper layers of geotextile material comprises lower and upper layers of geogrid web material.

4. The retaining wall structure according to claim 1 wherein the lower and upper layers of geotextile material are positioned at one predetermined vertical height of the retaining wall.

5. The retaining wall structure according to claim 1 wherein a plurality of the lower and upper layers of geotextile material are positioned at a corresponding plurality of predetermined vertical heights of the retaining wall.

6. The retaining wall structure according to claim 1 wherein the upper layer of geotextile material extends from the leading edge of the lower layer of geotextile material to about 10%–30% of the total length of the lower layer of geotextile material between the leading edge and the trailing edge thereof.

7. The retaining wall structure according to claim 6 wherein the upper layer of geotextile material is a separate layer of the same type of geotextile material that the lower layer of geotextile material is made of.

8. The retaining wall structure according to claim 6 wherein the upper layer of geotextile material is a continuous portion of the lower layer that is folded back upon itself and placed on top of the lower layer of geotextile material.

9. The retaining wall structure according to claim 6 wherein the upper layer of geotextile material is a continuous portion of the lower layer that is wrapped around a connector bar adjacent the face of the retaining wall and folded back upon itself and placed on top of the lower layer of geotextile material.

10. In a retaining wall structure for soil stabilization of earthen slopes and embankments comprising a plurality of courses of side-by-side and abutting cementations blocks having a width and a depth and being stacked together to define a retaining wall; a backfill material provided behind the retaining wall; and a single layer of mesh material defining a leading edge and a trailing edge wherein the leading edge is disposed between vertically adjacent blocks at a predetermined vertical height of the retaining wall and the trailing edge extends laterally backward therefrom into the backfill material and is engaged thereby, the improvement comprising:

(a) providing a double layer geogrid web having a width comprising a plurality of block widths in lieu of the single layer of mesh material and comprising an upper layer defining a leading edge and a trailing edge and a lower layer defining a leading edge and a trailing edge wherein the layers are in contact with each other and are disposed the entire depth between the vertically adjacent blocks and extend across a plurality of block widths; and (b) wherein the upper layer extends from the leading edge of the lower layer towards the trailing edge of the lower layer; and wherein the upper layer extends for a length from the retaining wall that is at least the depth disposed between the vertically adjacent blocks thereof.

11. The retaining wall structure according to claim 10 wherein the backfill material is soil or gravel designed to specifically meet drainage and connection/anchorage requirements of the wall.

12. The retaining wall structure according to claim 10 wherein the lower and upper layers of geogrid web material are positioned at one predetermined vertical height of the retaining wall.

13. The retaining wall structure according to claim 10 wherein a plurality of the lower and upper layers of geogrid web material are positioned at a corresponding plurality of predetermined vertical heights of the retaining wall.

14. The retaining wall structure according to claim 10 wherein the upper layer of geogrid web material extends from the leading edge of the lower layer of geogrid web material to about 10%–30% of the total length of the lower layer of geogrid web material between the leading edge and the trailing edge thereof.

15. The retaining wall structure according to claim 14 wherein the upper layer of geogrid web material is a separate layer of the same type of geogrid web material that the lower layer of geogrid web material is made of.

16. The retaining wall structure according to claim 14 wherein the upper layer of geogrid web material is a continuous portion of the lower layer that is folded back upon itself and placed on top of the lower layer of geogrid web material.

17. The retaining wall structure according to claim 14 wherein the upper layer of geogrid web material is a continuous portion of the lower layer that is wrapped around a connector bar adjacent the face of the retaining wall and folded back upon itself and placed on top of the lower layer of geogrid web material.

18. A method for forming a retaining wall structure for mechanically stabilized earth, comprising the steps of:

(a) stacking together a plurality of courses of side-by-side and abutting cementatious blocks having a width and a depth to define a retaining wall;

(b) providing a backfill material behind the retaining wall;

(c) providing a lower layer of geogrid web material having a width comprising a plurality of block widths and having a leading edge and a trailing edge, and disposing the leading edge the entire depth between vertically adjacent blocks at a predetermined vertical height of the retaining wall, and positioning the trailing edge to extend laterally backward therefrom into the backfill material such that the layer is engaged by the backfill material; and (d) providing an upper layer of geogrid web material having a width comprising a plurality of block widths and positioning the upper layer of geogrid web material so as to extend parallel to and to overlay and contact at least a portion of the length of the lower layer of geogrid web material; wherein the upper layer extends from the leading edge towards the trailing edge of the lower layer; and wherein the upper layer extends for a length from the retaining wall that is at least the depth disposed between the vertically adjacent blocks thereof;

whereby a retaining wall structure having a high strength connection between the retaining wall and backfill material therebehind by the lower and upper layers of geogrid web material is constructed.

19. The method for forming a retaining wall structure according to claim 18 including positioning the lower and upper layers of geogrid web material at one predetermined vertical height of the retaining wall.

20. The method for forming a retaining wall structure according to claim 18 including positioning the lower and upper layers of geogrid web material at a plurality of predetermined and spaced-apart vertical heights of the retaining wall.

21. The method for forming a retaining wall structure according to claim 18 including extending the upper layer of geogrid web material from the leading edge of the lower layer of geogrid web material to about 10%–30% of the total length of the lower layer of geogrid web material between the leading edge and the trailing edge thereof.

22. The method for forming a retaining wall structure according to claim 18 wherein the upper layer of geogrid web material is a separate layer of the same type of geogrid web material that the lower layer of geogrid web material is made of.

23. The method for forming a retaining wall structure according to claim 18 wherein the upper layer of geogrid web material is a continuous portion of the lower layer that is folded back upon itself and placed on top of the lower layer of geogrid web material.

24. The method for forming a retaining wall structure according to claim 18 wherein the upper layer of geogrid web material is a continuous portion of the lower layer that is wrapped around a connector bar adjacent the face of the retaining wall and folded back upon itself and placed on top of the lower layer of geogrid web material.

25. A retaining wall structure for soil stabilization of earthen slopes and embankments, comprising:

(a) a plurality of courses of cementations blocks having a width and a depth and being stacked together to define a retaining wall;

(b) a backfill material provided behind the retaining wall;

(c) a lower layer of geotextile material defining a leading edge and a trailing edge, and having the leading edge disposed the entire depth between vertically adjacent blocks at a predetermined vertical height of the retaining wall, and the trailing edge extending laterally backward therefrom into the backfill material such that the layer is engaged by the backfill material;

(d) an upper layer of geotextile material provided so as to extend parallel and to overlay and contact at least a portion of the length of the lower layer of geotextile material; wherein the upper layer extends from the leading edge towards the trailing edge of the lower layer; and wherein the upper layer extends for a length from the retaining wall that is at least the depth disposed between the vertically adjacent blocks thereof;

(e) wherein the upper layer of geotextile material extends from the leading edge of the lower layer of geotextile material to about 10%–30% of the total length of the lower layer of geotextile material between the leading edge and the trailing edge thereof; and (f) wherein the upper layer of geotextile material is a separate layer of a different type of geotextile material that the lower layer of geotextile material is made of;

whereby a high strength connection between the retaining wall and the backfill material by the lower and upper layers of geotextile material is provided.

26. In a retaining wall structure for soil stabilization of earthen slopes and embankments comprising a plurality of courses of cementations blocks having a width and a depth and being stacked together to define a retaining wall; a backfill material provided behind the retaining wall; and a single layer of mesh material defining a leading edge and a trailing edge wherein the leading edge is disposed the entire depth between vertically adjacent blocks at a predetermined vertical height of the retaining wall and the trailing edge extends laterally backward therefrom into the backfill material and is engaged thereby, the improvement comprising:

(a) providing a double layer geogrid web in lieu of the single layer of mesh material and comprising an upper layer defining a leading edge and a trailing edge and lower layer defining a leading edge and a trailing edge wherein the layers are in contact with each other;

(b) wherein the upper layer extends from the leading edge of the lower layer towards the trailing edge of the lower layer; and wherein the upper layer extends for a length from the retaining wall that is at least the depth disposed between the vertically adjacent blocks thereof;

(c) wherein the upper layer of geogrid web material extends from the leading edge of the lower layer of geogrid web material to about 10%–30% of the total length of the lower layer of geogrid web material between the leading edge and the trailing edge thereof; and (d) wherein the upper layer of geogrid web material is a separate layer of a different type of geogrid web material that the lower layer of geogrid web material is made of.

27. A method for forming a retaining wall structure for mechanically stabilized earth, comprising the steps of:

(a) stacking together a plurality of courses of cementatious blocks having a width and a depth to define a retaining wall;

(b) providing a backfill material behind the retaining wall;

(c) providing a lower layer of geogrid web material having a leading edge and a trailing edge, and disposing the leading edge the entire depth between vertically adjacent blocks at a predetermined vertical height of the retaining wall, and positioning the trailing edge to extend laterally backward therefrom into the backfill material such that the layer is engaged by the backfill material;

(d) providing an upper layer of geogrid web material and positioning the upper layer of geogrid web material so as to extend parallel to and to overlay and contact at least a portion of the length of the lower layer of geogrid web material; wherein the upper layer extends from the leading edge towards the trailing edge of the lower layer; and wherein the upper layer extends for a length from the retaining wall that is at least the depth disposed between the vertically adjacent blocks thereof; and (e) wherein the upper layer of geogrid web material is a separate layer of a different construction of geogrid web material that the lower layer of geogrid web material is made of;

whereby a retaining wall structure having a high strength connection between the retaining wall and backfill material therebehind by the lower and upper layers of geogrid web material is constructed.

* * * * *